US006341863B1

(12) United States Patent
Chen-Lieh

(10) Patent No.: US 6,341,863 B1
(45) **Date of Patent: *Jan. 29, 2002**

(54) DIVING MASK

(75) Inventor: Pan Chen-Lieh, Ilan Hsing (TW)

(73) Assignee: QDS Injection Molding Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/568,159

(22) Filed: May 10, 2000

(30) Foreign Application Priority Data

Feb. 29, 2000 (TW) ..... 89203167 U

(51) Int. Cl.[7] ..... G02C 1/00
(52) U.S. Cl. ..... 351/43; 2/428; 2/430
(58) Field of Search ..... 351/43, 41; 2/426, 2/427, 428, 430

(56) References Cited

U.S. PATENT DOCUMENTS 4,468,819 A * 9/1984 Ohno ..... 381/43

* cited by examiner

*Primary Examiner*—Hung Xuan Dang
(74) *Attorney, Agent, or Firm*—Troxell Law Office PLLC

(57) ABSTRACT

A diving mask having a lens providing a wide view field, which is formed by glueing together of multiple glasses, using a glue with elastic and flexible properties. The planes of the connection between the glasses is designed to overlap or be parallel with the line of sight.

7 Claims, 4 Drawing Sheets

DIVING MASK

FIELD OF THE INVENTION

The present invention relates to a diving mask, especially, to providing a lens with wider view field and frame structure.

BACKGROUND OF THE INVENTION

The angle of view field provided by general diving mask with single viewing window (single lens) or double viewing windows (double lenses) is narrower than the ordinary view field of a person. The diving mask with three viewing windows or four viewing windows is commercially available at present (such as M30–M40 produced by TABATA CO. CTD; Hawaii 3 produced by Aqua Lung America, Inc., WM-7302P, WM-7401 produced by UNIDIVE DIVING INDUSTRY CO., LTD etc.), its left and right side viewing windows are viewing windows integrating transparent material with the frame body or inserting two pieces of plane glasses in left and right sides. The diving mask provided by above-mentioned three viewing windows or four viewing windows is practically limited to the "frame edge" (as shown in FIG. 6) which is provided between the front viewing window and left-right viewing windows, the view field is influenced, so that the effect is not good.

According to the above-mentioned position, there is a design which is made of curved glass and can provide a wide view field, but which is not popular because the cost of building is too expensive. The glass used as lens must be "tempered glass" which is not easily broken to cause a sharp and dangerous state. Most tempered glasses are planar. When a non-planar state is to be made, it is not only difficult in manufacturing, but also is very expensive and is not adaptable to mass production. Also, problems of quality such as thickness, planeness and transparency are not easily overcome.

SUMMARY OF THE INVENTION

The present invention is a diving mask which can provide a wider view field, and especially relates to its lens structure. A lens providing a front and side view field is connected by glueing "tempered glass" with "tempered glass", a structure without a longitudinal frame between the front viewing window and the side viewing window of the diving mask is formed by means of the lenses which are connected with a sub-frame, skirt and main frame.

The slope-connection plane for the glued position between above-mentioned glasses is designed with an angle which is parallel (or overlap) with the "line of sight", which is only a thin line, so that hindrance or influence to the view field is very slight.

The glue for connection between the above-mentioned glasses can be UV silicone glue which can provide not only a good waterproof connection, but also has elastic and flexible properties between the glasses, so that movement through a small angle between two glasses can be made.

The lens structures can be glued by glass which is more than two pieces (such as three pieces or four pieces etc.), when using the above-mentioned constitutional characteristics.

The lens of the diving mas can be a single lens with a lens on each left and right side, when using the above-mentioned constitutional characteristics.

The problems of safety, mass production and cost related to the diving mask can be solved because the lens structure provided by the present invention can use "planar" and "tempered glass" as the material, except that it provides a wider view field during diving.

DETAILED DESCRIPTION OF THE INVENTION

Figure 1:
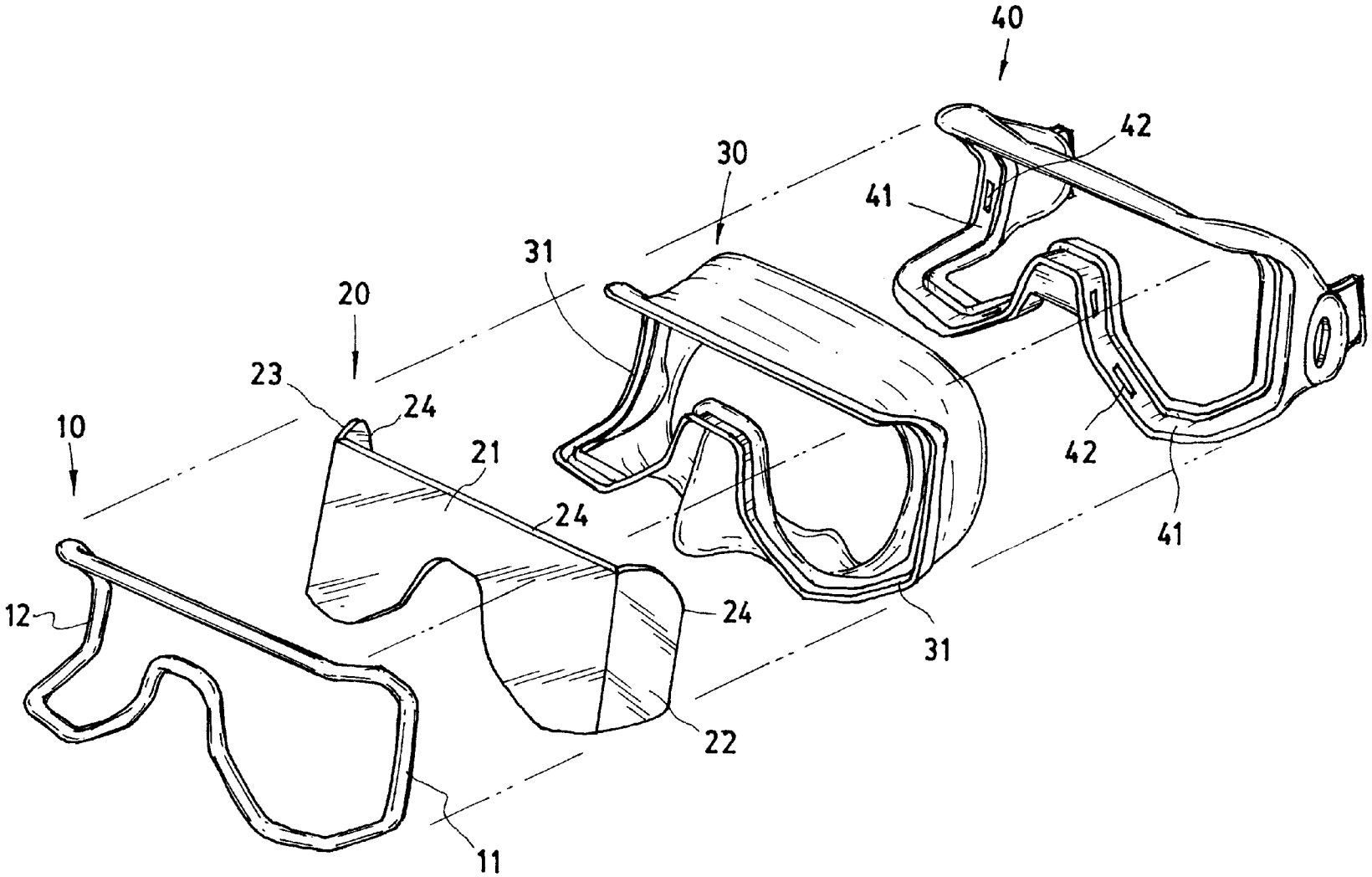
FIG. 1 is a perspective exploded view of the present invention.
Figure 2:
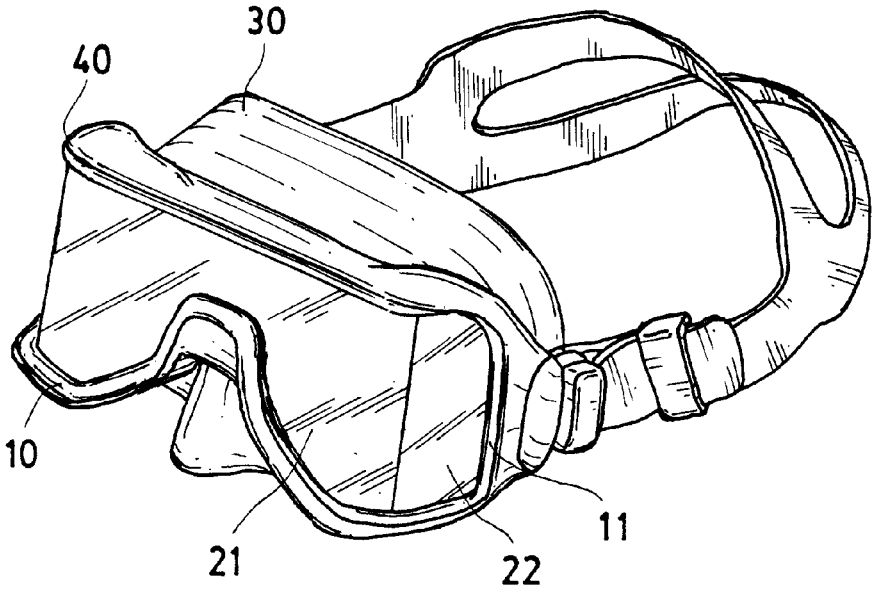
FIG. 2 is a perspective view of the invention.

As shown in FIG. 1, the constitution of the present invention includes a sub-frame 10, one lens 20, skirt 30 and a main frame 40.

The sub-frame 10 is provided in the front of the lens 20, which can be integrated with the main frame 40 by means of a clicking member, the lens 20 and the frame edge 31 of the skirt 30 are clicked between both sides. Both side frames 11, 12 of the sub-frame 10 structure for the present invention are in a sweepback state, its sweepback angle is fitted with the form of lens 20.

The lens 20 includes front glass 21 and side glasses 22, 23 in its sides. The front glass 21 and side glasses 22, 23 are connected by glue, such that water or liquid cannot be passed through. The glue can be selected materials such as UV silicone glue. In addition to having a watertight function, it is also quite elastic and flexible. Thus, the watertight connecting state can remain even if the front glass 21 and side glasses 22, 23 are slightly deformed.

The skirt 30 provided behind the lens 20, is made from transparent plastic materials (such as clear silicone etc.). The frame edge 31 of the skirt 30 is fitted with the edge 24 of the lens 20, and is connected in the frame slot 41 of the main frame 40.

The main frame 40 is analogous to a conventional main frame, with a frame slot 41 and several connecting clicking members 42 provided thereon. Sub-frame 10, lens 20 and frame edge 31 are placed on the frame slot 41, and the diving mask is connected in a stable state by means of the connection between the connecting clicking member 42 and clicking members of sub-frame 10.

Figure 3:
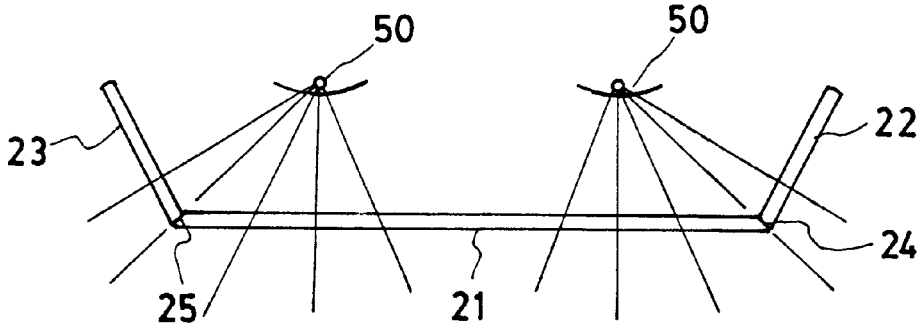
FIG. 3 is a schematic view of fitting state for the lens of the present invention with the line of sight.

The schematic view of the lens 20 relative to a line of sight for eyes 50 is as shown in FIG. 3. The connecting planes 24, 25 are between the front glass 21 and side glasses 22, 23, with directions of the planes and the direction for a line of sight for eyes 50 are designed to be parallel or overlap state, so that the influence of the connecting planes 24, 25 on the line of sight is slight.

Figure 4:
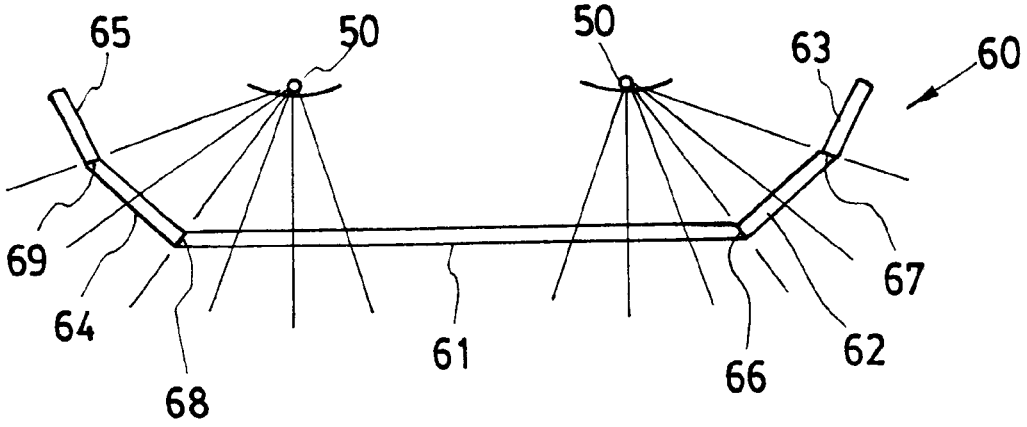
FIG. 4 is a perspective view of another embodiment for the lens of the present invention.

Another embodiment of the lens is as shown in FIG. 4, in which the front glass 61, has a multiple-glass structure provided on each side, i.e. the side glass 62, 63, 64, 65 are provided on each side. The tangent planes of each connection plane 66, 67, 68, 69 therein is aligned with the line of sight.

Figure 5:
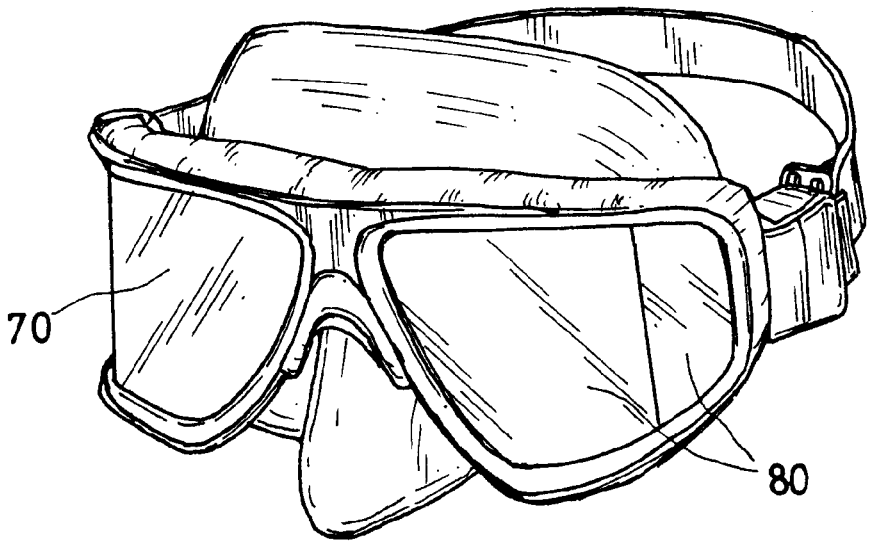
FIG. 5 is a view of another embodiment for the diving mask of the present invention.
Figure 6:
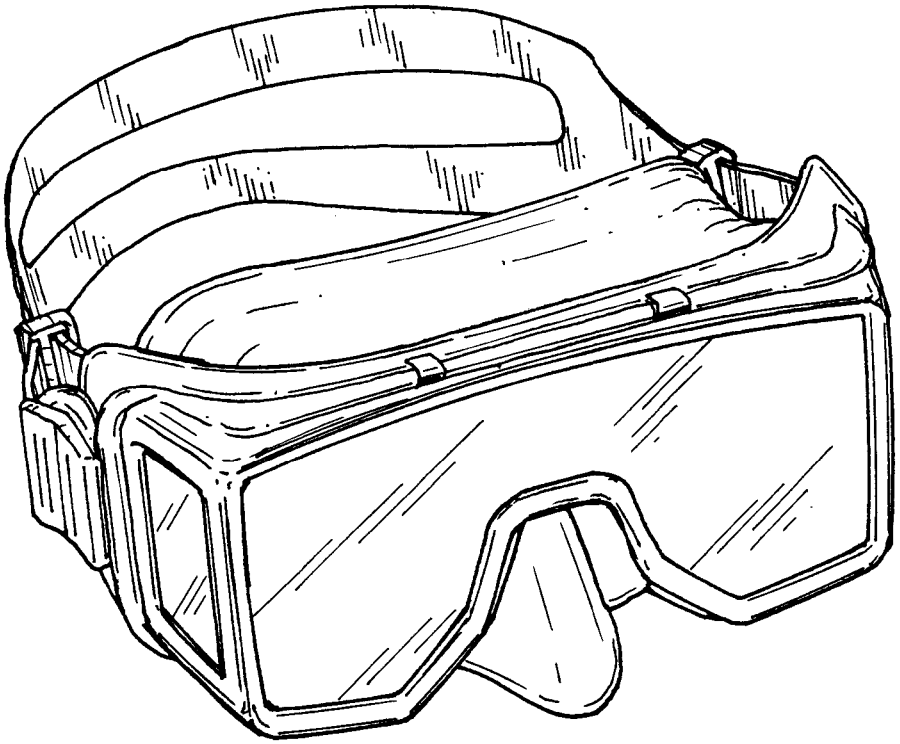
FIG. 6 (PRIOR ART)
FIG. 6 is a perspective view of a conventional diving mask.

Another embodiment of the diving mask is shown in FIG. 5, wherein there are two two-piece lenses 70, 80 provided on each side.

The above-mentioned are embodiments, the main characteristic of the present invention is the construction of the "lens". The structure of sub-frame, skirt and main frame or the connecting fashion as not limited to the above-mentioned description.

What is claimed is:

1. A multi-piece lens for an eye mask comprising:

a) a tempered glass planar front lens having opposite first side edges;

b) two tempered glass planar side lenses, each having at least one second side edge; and, c) a glue material between the first and second side edges to attach the tempered glass planar side lenses to the opposite side edges of the tempered glass planar front lens such that each of the tempered glass planar side lenses forms an obtuse angle of less than 180° with the tempered glass planar front lens.

2. The multi-piece lens of claim 1 further comprising:

a) a third side edge on each tempered glass planar side lenses;

b) two second tempered glass planar side lenses, each having a fourth side edge; and, c) a second glue material between each of the third and fourth side edges to attach each second tempered glass planar side lens to one of the two tempered glass planar side lenses such that each second tempered glass side lens forms a second obtuse angle of less than 180° with the associated tempered glass side lens.

3. The multi-piece lens of claim 1 wherein the glue material comprises a waterproof and flexible silicone glue.

4. An eye mask with a multi-piece, wide angle viewing lens comprising:

a) a main frame assembly including a skirt having a lens opening configured to be placed on a face of a user so as to enclose eyes of the user, the skirt having a lens opening;

b) a multi-piece lens located in the lens opening of the skirt, the lens comprising:

i) a tempered glass planar front lens having opposite side edges;

ii) two tempered glass planar side lenses, each having at least one second side edge;

iii) a glue material between the first and second side edges to attach the tempered glass planar side lenses to the opposite side edges of the tempered glass planar front lens such that each of the tempered glass planar side lenses forms an obtuse angle of less than 180° with the tempered glass planar front lens; and, c) a sub-frame mounting the lens to the skirt.

5. The eye mask of claim 4 wherein the opposite side edges each has a planar configuration, the planes of the side edges extending parallel to a field of vision of the user's eyes.

6. The eye mask of claim 4 further comprising:

a) a third side edge formed on each tempered glass planar side lens;

b) two second tempered glass planar side lenses, each having a fourth side edge; and, c) a second glue material between each of the third and fourth side edges to attach each second tempered glass planar side lens to one of the two tempered glass planar side lenses such that each second tempered glass side lens forms a second obtuse angle of less than 180° with the associated tempered glass side lens.

7. The eye mask of claim 4 wherein the glue material comprises a waterproof and flexible silicone glue.

* * * * *